US007578402B2

(12) United States Patent
Paschke

(10) Patent No.: US 7,578,402 B2
(45) Date of Patent: Aug. 25, 2009

(54) TELESCOPIC CRANE JIB PART WITH CROSS SECTIONAL SEGMENTS OF VARYING CURVATURE

(75) Inventor: Franz Paschke, Sande (DE)

(73) Assignee: Manitowoc Crane Group France SAS, Ecully (FR)

( * ) Notice: Subject to any disclaimer, the term of this patent is extended or adjusted under 35 U.S.C. 154(b) by 72 days.

(21) Appl. No.: 11/723,899

(22) Filed: Mar. 22, 2007

(65) Prior Publication Data

US 2008/0047920 A1 Feb. 28, 2008

(30) Foreign Application Priority Data

Mar. 29, 2006 (DE) ..... 10 2006 014 573

(51) Int. Cl.
*B66C 23/04* (2006.01)

(52) U.S. Cl. ..... 212/348

(58) Field of Classification Search ..... None
See application file for complete search history.

(56) References Cited

U.S. PATENT DOCUMENTS 6,978,907 B2 12/2005 Paschke

FOREIGN PATENT DOCUMENTS

| | | | | |
|---|---|---|---|---|
| DE | 200 04 016 | U1 | | 7/2001 |
| DE | 201 20 121 | U1 | | 4/2002 |
| EP | 668 238 | A1 | * | 2/1995 |
| EP | 0 668 238 | A1 | | 8/1995 |
| FR | 2 502 132 | A | * | 9/1982 |
| FR | 2 790 538 | A | * | 9/2000 |
| GB | 2 134 072 | A | | 8/1984 |
| JP | 10-157980 | A | * | 6/1998 |
| JP | 2005-112514 | A | * | 4/2005 |

* cited by examiner

*Primary Examiner*—Thomas J. Brahan
(74) *Attorney, Agent, or Firm*—Brich, Stewart, Kolasch & Birch, LLP

(57) ABSTRACT

A telescopic crane jib part has a top profiled part and a bottom profiled part joined together at joining points. The top profiled part and the bottom profiled part, on a side of the cross-section defining one-half of the cross section that is symmetrical with respect to the vertical mid-plane, each comprise, starting from the joining point of the profiled parts, at least a less pronounced outwardly curved segment and a more pronounced outwardly curved segment. Mutually adjoining end segments of the top and bottom profile parts meet at the joining points and extend outwards forming an angle.

16 Claims, 4 Drawing Sheets

FIG. 1

TELESCOPIC CRANE JIB PART WITH CROSS SECTIONAL SEGMENTS OF VARYING CURVATURE

The invention relates to a telescopic crane jib part with a top profiled part and a bottom profiled part, with curved cross-sectional segments.

BACKGROUND OF THE INVENTION

Patent specification EP 0 449 208 A2 discloses jib sections which are more or less round or, instead of a circle, are based on an upstanding ellipsis. Jibs made from these cross-sections have a relatively low rigidity about the vertical and horizontal axis, a relatively low torsion resistance and a low resistance to twisting. Sections with half-box shaped or, alternatively, trapezoidal top shells are also described. The straight legs of the top and bottom shell portions lie in one plane. With this shape, the two lateral and the top segments are highly susceptible to buckling.

Patent specification EP 0 668 238 A1 discloses a jib section, comprising a half-box shaped segment and a rounded bottom segment. The rounded bottom segment has at least one flat wall portion. The straight legs of the top half-box shaped segment lie parallel with the vertical axis of symmetry of the section and are joined to the bottom legs. Both the top and the bottom jib segments are highly susceptible to instability, especially during displacement, in the regions of the overlap and at points where force is transmitted.

Document DE 200 04 016 U1 discloses a jib cross-section with a bottom rounded part and a top half-box shaped part, the oppositely facing legs of which are welded to one another. The top part has the shape of an equal-sided trapezium without a longer base line. Extending parallel with the vertical axis of symmetry, the legs of the bottom section abut with the legs of the top profiled part forming an angle. In order to reduce the risk of buckling in the thinner top shell, the thicker bottom shell must terminate far beyond the neutral zone of the cross-section. Furthermore, the overall cross-section is less rigid due to the fact that the straight web walls are drawn in. A jib of this design is higher in weight and has a greater overall deformation.

A telescopic jib with a bottom segment comprising several adjoining, outwardly curved shell segments is disclosed in patent specifications DE 196 24 312 A1 and EP 0 814 050 B1. The bending strength, torsion resistance and efficient transmission of load in the bottom part, which is subjected to pressure, is significantly improved. This cross-section also has a top half-box shaped segment in which the straight legs lying in one plane are welded to one another.

Utility model DE 202 20 121 U1 describes a jib cross-section with a top shell comprising two outwardly curved shell segments, and the straight leg ends of the top and bottom cross-section parts extend parallel with the vertical axis of symmetry and are welded to one another. With this known profile, not only is the bottom part designed to withstand pressure stresses, resistance to buckling is also increased in the top part.

With the known telescopic jibs, attempts have therefore been made to optimize the top shell or the bottom shell, depending on the type of crane. There is no perceptible standard overall concept. Crane jibs are primarily subjected to bending stress perpendicular to and transversely to the luffing plane. Due to wind, pivoting, etc., the jib is subject to high lateral loads. If the jib is additionally anchored or pre-tensioned, the entire top and bottom part is subjected to pressure stresses. In standard jib cross-sections, the top cross-sectional part is primarily made from flat sheets and the outer corners are rounded. All of these cross-sections in which the top segment is of a half-box shaped design are highly susceptible to buckling. The bottom cross-sectional part differs significantly from the top part in terms of its shape and the shell segments and/or multiple edges are intended to improve resistance to buckling and load transmission.

The Present Invention

The present invention provides a telescopic jib profile which overcomes the disadvantages known from the prior art. The invention provides a high rigidity about both axes and makes the jib more resistant to buckling on all sides due to a consistent disposition of segments, both in the top and in the bottom cross-sectional parts. A jib according to the invention has a cross-section which occupies the same amount of space as other jibs but is capable of handling higher loads.

In accordance with the present invention a top cross-sectional part and the bottom cross-sectional part of a jib are designed so that they are resistant to bending and resistant to buckling. The geometrical moments of inertia about both jib axes should be as high as possible. This is accomplished by the invention, even though these requirements are actually in contradiction with one another because a narrow radius or inwardly inclined side walls increases resistance to buckling but reduces geometrical moments of inertia and hence the overall rigidity. The present invention takes into consideration the fact that optimum use must be made of the standing space available for a jib. A tight nesting of the telescopic parts is necessary. Manufacturing complexity, orientation work and extra weights are minimized if reinforcements fitted subsequently to increase buckling resistance are no longer needed.

The invention may include a telescopic crane jib part with a top profiled part and a bottom profiled part with curved cross-sectional portions, the top profiled part and the bottom profiled part having, on one side of the cross-section which is symmetrical with respect to the vertical mid-plane, a segment with a less pronounced outward curvature and a segment with a more pronounced outward curvature, starting from the joining point of the profiled parts in each case, and the mutually adjoining end segments at the joining point extend outwards at an angle.

A combination of more pronounced outwardly curved segments with adjoining less pronounced outwardly curved segments and adjoining end segments or leg ends inclined outwards at an angle, as contemplated by the invention, provides for more material of the cross-section being disposed at a greater distance from its gravitational axes and optimum use can be made of the available space. The buckling width of the lateral segments with the less pronounced outward curvature with their adjoining leg ends is clearly limited both in the top part and in the bottom part due to the segments with a less pronounced outward curvature and due to the obtuse angle subtended by the leg ends of the top and bottom part extending outwards at an angle. This combination improves the overall rigidity, resistance to torsion, resistance to buckling, load transmission and guiding properties of a jib.

The cross-section of a telescopic jib is subjected to different stresses in the overlap region, where displacement occurs in the collar or in the base and in the locking region. The cross-section proposed by the invention has a positive effect on all of these areas. The overlap or bearing length of the individual telescopic parts should be as short as possible. If the overlap length is short, the retracted jib is short (important for a short vehicle length) and is long when telescopically extended, and the overall weight is low. With a short overlap length, shearing stress is high. Due to the design proposed by the invention, the cross-sectional faces are able to absorb higher shearing stress. The lateral edges in conjunction with the outwardly curved shell segments increase the bearing capacity of the cross-section because the likelihood of failure due to shearing-induced buckling is significantly reduced.

Particular attention must be paid to the inner telescopic part in the region of the mounting in the collar of the outer telescopic part. The inner telescopic part is exposed to a state of stress in three axes. The curved segments in the top and bottom profiled part in conjunction with the lateral edges resulting from the outwardly inclined shell segments are capable of absorbing high loads on a narrow space, ensure that the cross-section remains level, guide the jib part very accurately during the telescoping movement and prevent outward buckling. Due to the fact that the leg ends extend outwards at an angle and form an edge constituting the outermost lateral boundary of the cross-section, the web ends can additionally be mounted in the collar. The thicker locking plates no longer have a detrimental effect during the telescoping movement.

Since the base of an inner telescopic part is borne in an outer one, the outer sleeve is not subjected to pressure stresses acting transversely to the jib direction as is the case in the collar region, but to additional tensile stresses. By contrast with the collar region, the deformation direction of the side parts extends inwards. Additional pinching of the cross-section must be avoided so that the lateral geometrical moment of inertia of the second order is not reduced and the lateral deformation of the jib as a whole is not increased.

If the normal force is transmitted from one telescopic part to the other via two laterally disposed locking units, the locking plates are thicker than the jib base plates. Due to the tight nesting of the jib parts, the locking plates known from the prior art are often disposed off-centre. As a result of the cross-section proposed by the invention with its leg ends inclined outwards at an angle, the bolt force is transmitted centrally. The distribution of stress is more uniform and bending stresses due to eccentricities do not occur. This therefore saves on material.

Another advantage of the proposed disposition of the side segments resides in the fact that the effective cross-section is not reduced due to buckling when exposed to high locking forces and high lateral stress.

The end segments may lie with respect to one another or abut with one another at an obtuse angle. A lateral construction comprising two outwardly curved shells in combination with outwardly inclined end segments or leg ends abutting with one another at an obtuse angle counteracts pinching of the cross-section.

In a preferred embodiment, the radii of the more pronounced, outwardly curved segments are shorter than the half width of the cross-section. Furthermore, the radii of the less pronounced, outwardly curved segments are preferably longer than the half width of the cross-section.

In one embodiment of the invention, the top and bottom profiled parts are welded to one another at the joining points. Another particular advantage of the leg ends extending outwardly inclined at an angle in conjunction with the outwardly curved segments is in the production process, especially during welding. Particularly with laser or hybrid welding methods, for which the gap for the butt seam must be narrow, there is no need for complex chamfering of the edges. During the welding process, the edge and the outwardly curved configuration prevent the cross-section side from dropping. Subsequent levelling work can be dispensed with.

In different embodiments, the outwardly inclined or extending end segments can be produced in different ways. One option is for the end segments to incorporate straight or flat segments, which are disposed after or adjoining the segments with a less pronounced curvature. This being the case, the end segments would therefore be provided separately and in addition to the curved segments. Alternatively, another option offered by the invention is for the end segments to be formed by the segments with a less pronounced curvature themselves, in which case these segments form an end portion part or such an end portion is formed.

The overall cross-section may assume different shapes within the context of the invention. In the top profiled part, the cross-section may have a straight or flat segment disposed after the segment with the more pronounced curvature or adjoining it, which forms the top, especially the top horizontal termination of the cross-section. In the top profiled part, the cross-section may also have another segment with a less pronounced curvature disposed after the segment with the more pronounced curvature or adjoining it, which forms the top termination of the cross-section, in which case the other segment specifically has a bigger radius of curvature than the segment with a less pronounced curvature lying closer to the joining point.

In one variant, the cross-section in the bottom profiled part has a straight or flat segment disposed after the segment with the more pronounced curvature or adjoining it, which forms the bottom, in particular the bottom horizontal termination of the cross-section. However, it would also theoretically be possible to select a design whereby the cross-section in the bottom profiled part has another segment with a less pronounced curvature disposed after the segment with the more pronounced curvature or adjoining it, which forms the bottom termination of the cross-section, in which case the other segment specifically has a radius of curvature that is bigger than or identical to that of the segment with the less pronounced curvature lying closer to the joining point (it is more economical to opt for an identical radius of curvature in a profiled part for the segments with a less pronounced curvature).

The radii of the segments with the more pronounced curvature in the top profiled part may be different from the radii of the segments with the more pronounced curvature in the bottom profiled part, in particular longer, but preferably not longer than the half width of the cross-section. The radii of the segments with the less pronounced curvature in the top profiled part may also be different form the radii of the segments with the less pronounced curvature in the bottom profiled part, in particular shorter, but preferably not shorter than the half width of the cross-section. Naturally, the invention also includes situations in which the relevant radii mentioned above in the top and bottom profiled parts are not different.

BRIEF DESCRIPTION OF THE DRAWINGS

The invention will also be explained in more detail and best understood with reference to examples of embodiments. The features described may be used individually or in any combination. In the drawings:

FIG. 1 illustrates a first embodiment of a telescopic crane jib part viewed in cross-section. The jib part is denoted by reference number 1 as a whole and comprises a top profiled part 10 and a bottom profiled part 20, which adjoin one another at two joining points, of which that on the left-hand side of the cross-section is denoted by reference number 2. The jib part 1 is symmetrical with respect to the vertical mid-plane 3. Its segments are, therefore, indicated on the left-hand side only and are identical in mirror image on the right-hand side.

Figure 1:
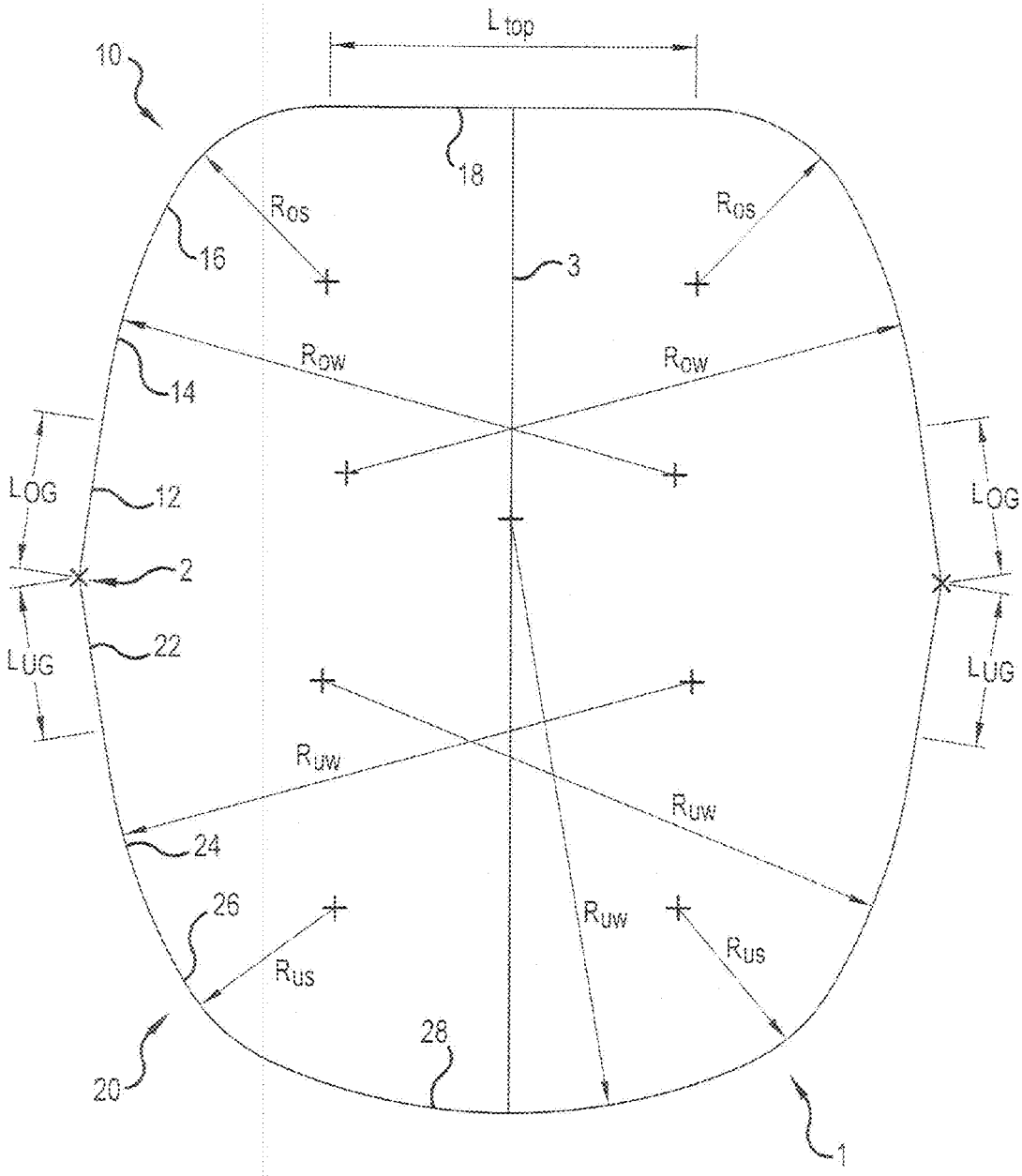
FIG. 1 shows a telescopic jib cross-section with straight leg-end segments and a straight top segment.

Viewed starting from the joining point 2, the top cross-section firstly comprises a straight (or flat or planar) end segment 12 extending outwards at an angle, of a length $L_{OG}$. Adjoining this straight segment 12, at a tangential transition, is a segment 14 with a relatively less pronounced curvature, the radius of curvature of which is indicted by $R_{OW}$. The radius of curvature $R_{OW}$ is substantially longer than the half width of the cross-section (half the width between the joining points 2). Disposed after the segment 14 which has a less pronounced curvature, again at a tangential transition, is a segment 16 with a relatively more pronounced curvature having a radius of curvature $R_{OS}$, which is significantly shorter than the half width of the cross-section. Segment 16 again merges in a rounded arrangement or at a tangent with a straight (planar or flat) segment 18, which is of identical length on either side of the mid-plane 3, forming the top termination of the cross-section of a length $L_{top}$.

Starting from the joining point 2, the bottom profiled part has the straight or flat or planar segment 22 of a length $L_{UG}$, the segment 24 with a less pronounced curvature having a radius $R_{UW}$ which is longer than the half width of the cross-section, in turn adjoined to the segment 26 with the more pronounced curvature having a radius $R_{US}$ which is significantly shorter than the half width of the cross-section and, disposed after it, the segment 28 likewise with a less pronounced curvature, which forms the bottom termination of the cross-section and also has a radius $R_{UW}$. The segments 22, 24, 26 and 28 merge with one another at a tangent and segment 28 lies symmetrically with respect to the mid-plane 3. For reasons pertaining to the production process, the transitions could also be of a rounded design.

The top profiled part 10 and the bottom profiled part 20 are welded to one another at the joining points 2, for which purpose it is already of advantage that the edges stand outwards and thus already afford a gap for the welding seam by dint of the construction. The lateral edges resulting at the joining point 2 increase the resistance of the overall cross-section to buckling. Together with the adjoining flat portions, they also make it easier to guide and mount the telescopic part. There is a perceptible harmonious overall design for the top and bottom profiled parts with a consistent disposition of segments which, due to their respective curvature, contribute to imparting a high degree of rigidity to both the top and the bottom cross-section part and hence the overall cross-section about both the vertical and horizontal axes. As a result of the curvatures proposed by the invention, a lot of the material of the cross-section is shifted outwards, and is so across the entire height of the jib part, which increases dimensional stability.

Figure 2:
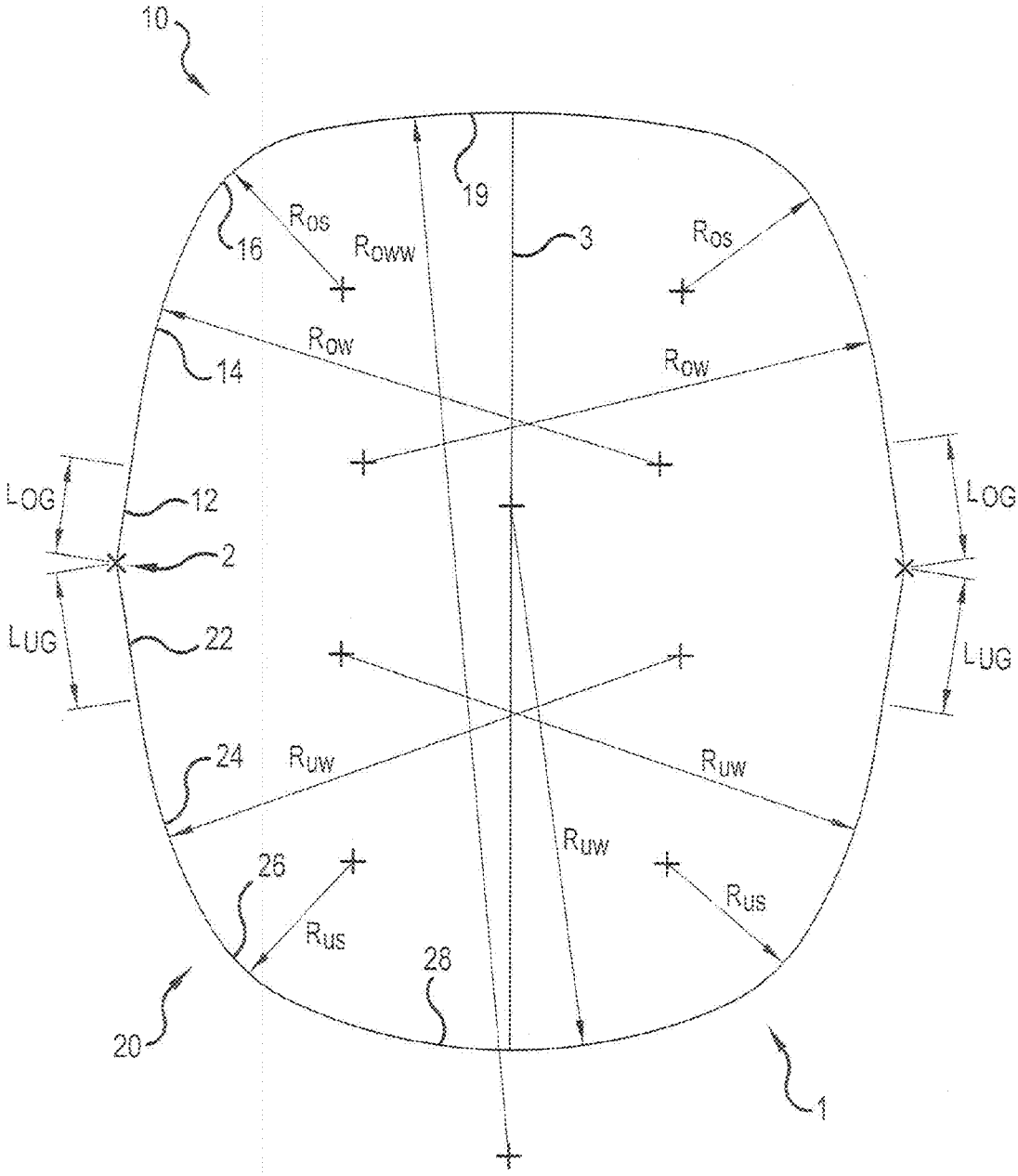
FIG. 2 shows a cross-section with straight leg-end segments and a top segment with a less pronounced outward curvature.
Figure 3:
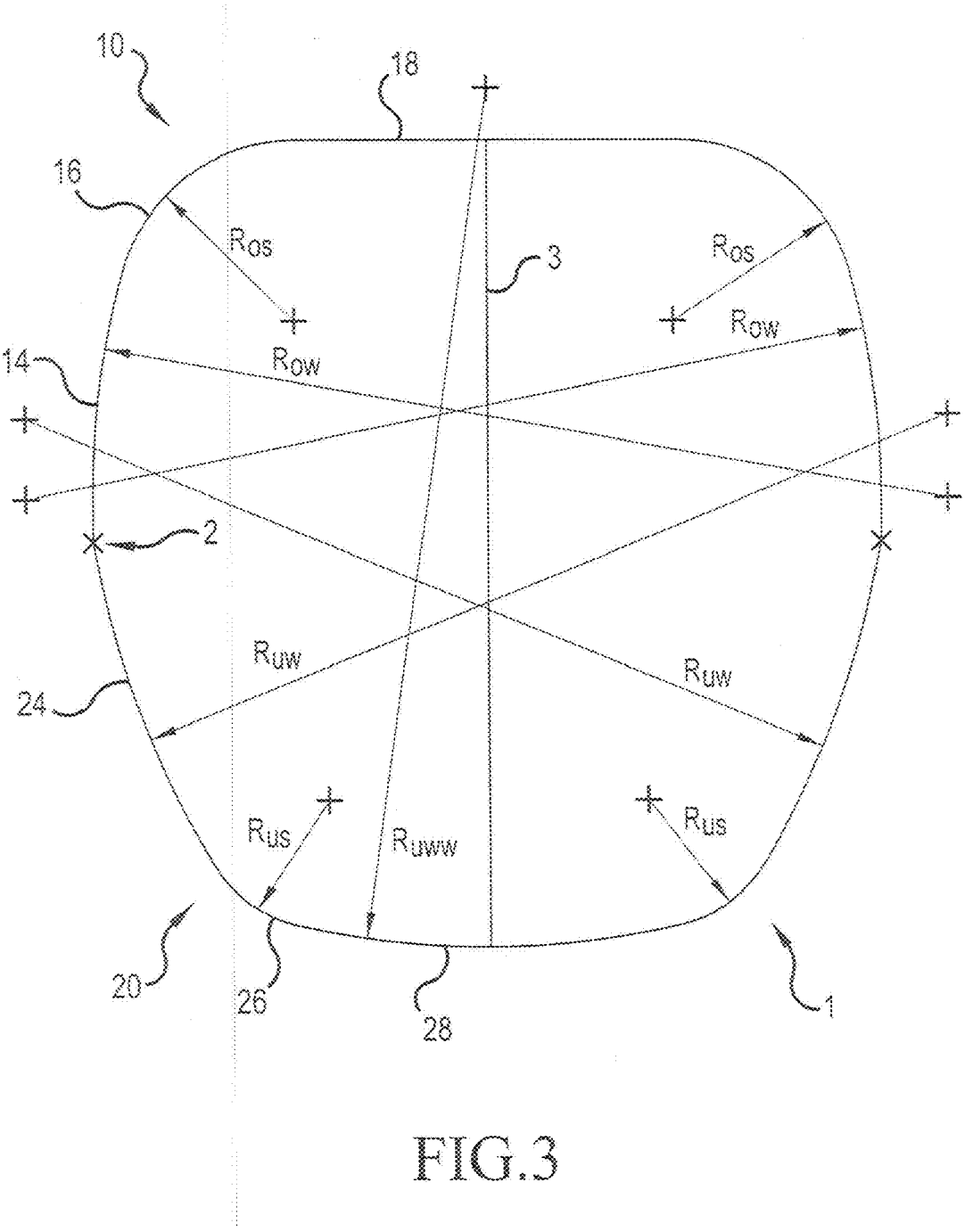
FIG. 3 shows a cross-section without separate straight leg-end segments and with a straight top segment.

The above considerations pertaining to dimensional stability and resistance to buckling also apply to the two other embodiments of the invention, illustrated in FIGS. 2 and 3. The same reference numbers are used to denote elements or segments fulfilling at least the same function and only those aspects which are different from the embodiment illustrated in FIG. 1 will be described.

Unlike the cross-section illustrated in FIG. 1, the cross-section illustrated in FIG. 2 does not have a top flat segment. In this embodiment, segment 16 with the more pronounced curvature is adjoined, again with a rounded or tangential transition, by a segment 19 extending symmetrically across the two sides of the mid-plane 3 and with an even less pronounced curvature than the slightly curved segment $R_{OW}$. The radius of curvature of segment 19 is denoted by $R_{OWW}$ and the advantage of this embodiment also resides in the fact that the curvature prevents the top segment from dipping when subjected to strong bending. Also, in the case of anchored or pre-tensioned systems, the top segment is able to absorb higher pressure forces, thereby increasing dimensional stability. The relatively flat curvature (long radius of curvature) of segment 19 in turn affords the appropriate bearing and guiding action. The embodiment illustrated in FIG. 2 is again provided with the flat or planar (straight) end segments 12, 22 which abut with one another at an obtuse angle forming a longitudinally extending edge, thereby contributing to buckling resistance.

The third embodiment illustrated in FIG. 3 also has a top flat portion formed by the straight or planar segment 18, which lies symmetrically about the mid-axis 3. Where this differs from the embodiments illustrated in FIGS. 1 and 2 is that the end segments adjoining the joining point are not designed as separate flat or planar segments. Instead, segments 14 and 24 with the less pronounced curvature in FIG. 3 abut directly at the joining point 2 but are still disposed in such a way in the region of the joining point that they extend outwards at an angle, resulting in an outwardly projecting edge at the joining point 2 which increases resistance to buckling.

Compared with the embodiments illustrated in FIGS. 1 and 2, the segments 14 and 24 with the less pronounced curvatures in the example illustrated in FIG. 3 are provided with very long radii. The segments 14 and 24 adjoining the joining point have radii $R_{OW}$ and $R_{UW}$, respectively, and the bottom termination segment 28 has the radius $R_{UWW}$.

Naturally, the design options illustrated in FIGS. 1, 2 and 3 may be used in any combination within the context of the invention.

Figure 4:
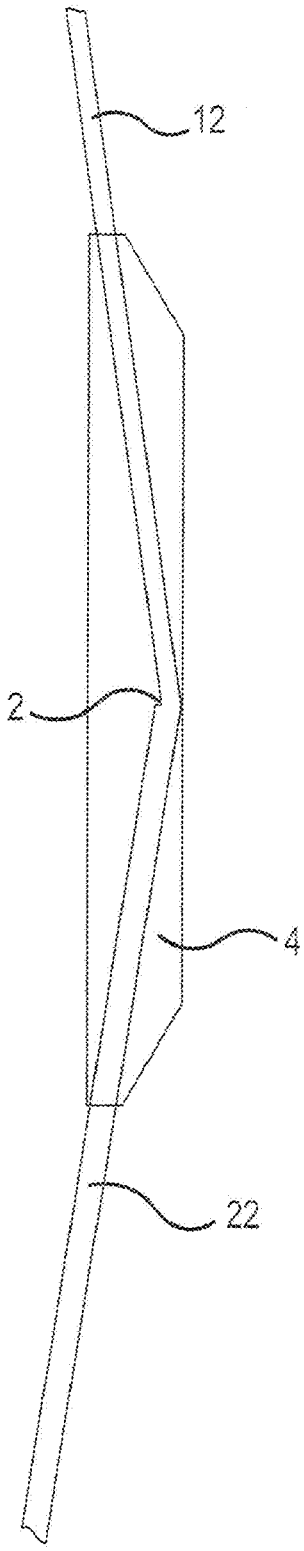
FIG. 4 shows a side of the cross-section with a locking plate.

FIG. 4 illustrates a detail of the jib of the invention at the joining point 2, which is defined by the juncture of two straight or flat segments 12 and 22 in the example illustrated. The segments 12 and 22 are welded to one another at the joining point 2, resulting in the readily visible, outwardly projecting longitudinal edge. A locking plate 4 might lie in the region of this longitudinal edge, as illustrated in FIG. 4, provided at points along the length of the jib part where locking bolts extend through the jib cross-section, causing a mechanical engagement of two adjacently lying telescopic parts.

Locking plates 4 disposed in this manner, extending across both sides of the joining point 2, do not have any detrimental effect on the telescoping movement and enable a tight nesting of the telescopic parts one inside the other. They nevertheless ensure that the normal force is transmitted centrally when moving one telescopic part in the other, which means that additional bending stress known to occur in prior art jibs due to the fact that the locking system is necessarily eccentrically disposed is not transmitted as a result of the invention. This in turn results in a saving on material and the jib as a whole may be of a lighter design.

The invention claimed is:

1. A telescopic crane jib part having a cross-section defined by a top profiled part and a bottom profiled part, said top profiled part having end segments and said bottom profiled part having end segments joined to the end segments of the top profiled part at joining points on each side of the cross section, each of the top and bottom profiled parts comprising curved cross-sectional portions, said top profiled part and said bottom profiled part each comprising, on a side of the cross-section on one side of the vertical mid-plane of the cross-section, in sequence in a direction extending from the joining point, at least a less pronounced outwardly curved segment and a more pronounced outwardly curved segment, and wherein the mutually adjoining end segments of the top and bottom portions, respectively, meet at the joining point and form an outwardly extending angle.

2. A telescopic crane jib part as in claim 1, wherein the end segments adjoin one another at an obtuse angle.

3. A telescopic crane jib part as in claim 1, wherein the radii of the more pronounced outwardly curved segments are shorter than one-half the width of the cross-section.

4. A telescopic crane jib part as in claim 1, wherein the radii of the less pronounced outwardly curved segments are longer than one-half the width of the cross-section.

5. A telescopic crane jib part as in claim 1, the top and the bottom profiled parts are welded to one another at the joining points.

6. A telescopic crane jib part as in claim 1, wherein the top profiled part or the bottom profiled part further comprises straight or flat end segments preceding and adjoining the less pronounced outwardly curved segments in sequence in a direction extending from said joining point.

7. A telescopic crane jib part as in claim 1, characterised wherein said end segments comprise the less pronounced outwardly curved segments.

8. A telescopic crane jib part as in claim 1, wherein the cross-section in the top profiled part has a straight or flat segment disposed after and adjoining the more pronounced curved segment, said flat segment forming the top portion of the cross-section.

9. A telescopic crane jib part as in claim 1, wherein the cross-section in the top profiled part comprises a second segment with a less pronounced curvature disposed after and adjoining said more pronounced curved segment, said second segment forming the top portion of the cross-section, and said second segment has a radius of curvature that is identical to or longer than said segment with the less pronounced curvature.

10. A telescopic crane jib part as in claim 1, wherein the cross-section of the bottom profiled part has a straight or flat segment disposed after and adjoining the more pronounced curved segment, said straight or flat segment forming the bottom portion of the cross-section.

11. A telescopic crane jib part as in claim 1, wherein the cross-section of the bottom profiled part has a second segment with a less pronounced curvature disposed after and adjoining the more pronounced curved segment, said second segment forming the bottom portion of the cross-section, and said second segment has a radius of curvature that is identical to or longer than the segment with the less pronounced curvature.

12. A telescopic crane jib part as in claim 1, wherein the radius of curvature of the segments with the more pronounced curvature in the top profiled part is longer than the radius of curvature of the segments with the more pronounced curvature in the bottom profiled part, but not longer than one-half the width of the cross-section.

13. A telescopic crane jib part as in claim 1, wherein the radius of curvature of the segments with the less pronounced curvature in the top profiled part is shorter than the radius of curvature of the segments with the less pronounced curvature in the bottom profiled part, but not shorter than one-half the width of the cross-section.

14. A telescopic crane jib part as in claim 1, wherein the top profiled part and the bottom profiled part each further comprises straight or flat end segments preceding and adjoining the less pronounced outwardly curved segments in sequence in a direction extending from said joining point.

15. A telescopic crane jib part as in claim 1, wherein the radius of curvature of the segments with the more pronounced curvature in the top profiled part is different than the radius of curvature of the segments with the more pronounced curvature in the bottom profiled part, but not longer than one-half the width of the cross-section.

16. A telescopic crane jib part as in claim 1, wherein the radius of curvature of the segments with the less pronounced curvature in the top profiled part is different than the radius of curvature of the segments with the less pronounced curvature in the bottom profiled part, but not shorter than one-half the width of the cross-section.

* * * * *